US006919758B1

(12) United States Patent
Preslar et al.

(10) Patent No.: US 6,919,758 B1
(45) Date of Patent: Jul. 19, 2005

(54) CONTROLLER FOR FET PASS DEVICE

(75) Inventors: Donald R. Preslar, Hillsborough, NJ (US); Thomas J. Hayes, Hillsborough, NJ (US)

(73) Assignee: Intersil Americas Inc., Milpitas, CA (US)

( * ) Notice: Subject to any disclaimer, the term of this patent is extended or adjusted under 35 U.S.C. 154(b) by 0 days.

(21) Appl. No.: 10/721,624

(22) Filed: Nov. 25, 2003

(51) Int. Cl.[7] ..... G05F 1/10
(52) U.S. Cl. ..... 327/541
(58) Field of Search ..... 327/530, 534, 327/535, 537, 538, 540, 541, 543

(56) References Cited

U.S. PATENT DOCUMENTS 5,831,471 A * 11/1998 Nakajima et al. ..... 327/540
6,225,857 B1 * 5/2001 Brokaw ..... 327/540
6,667,652 B2 * 12/2003 Hosoki ..... 327/538

* cited by examiner

*Primary Examiner*—Jeffrey Zweizig
(74) *Attorney, Agent, or Firm*—Gary R. Stanford

(57) ABSTRACT

A controller for regulating a FET to operate as a pass device including input, output and gate nodes coupled to a current path input, a current path output and the gate of the FET, respectively, a controlled low current device, and an oscillating high gain regulation amplifier. The voltage source provides a regulation voltage level relative to the input node. The low current device is coupled to the gate node and has a control input. The amplifier has a first input coupled to the output node, a second input coupled to the voltage source, and an output coupled to the control input of the controlled low current device to regulate the FET. The amplifier oscillates while regulating a voltage between the input and output nodes to the regulation voltage level. The controlled low current device presents a high impedance to the gate node to prevent oscillations from disturbing regulation.

21 Claims, 2 Drawing Sheets

CONTROLLER FOR FET PASS DEVICE

BACKGROUND OF THE INVENTION

1. Field of the Invention

Figure 1:
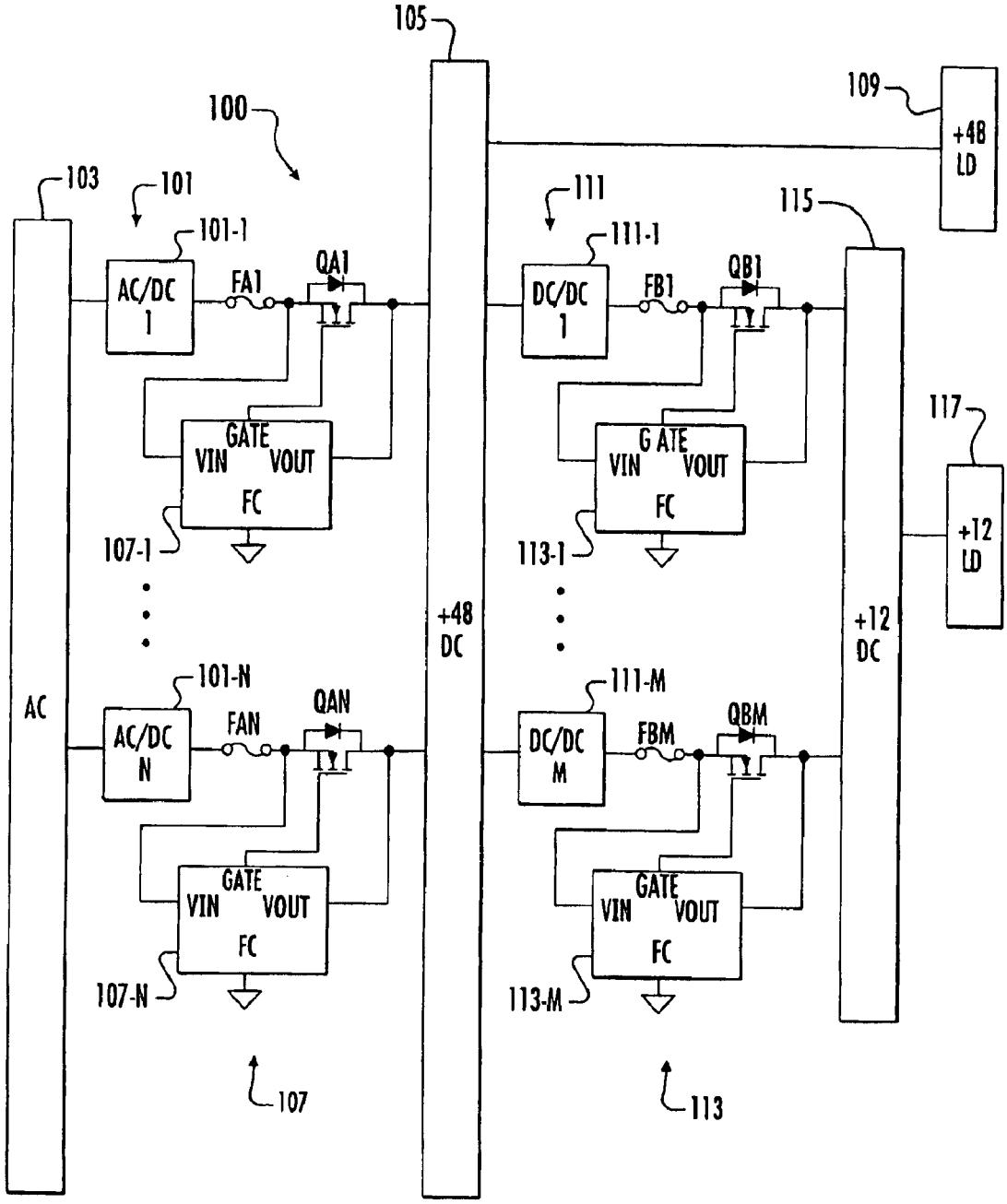

The present invention relates to redundant power distribution systems, and more particularly to replacing a power ORing diode with a FET and a controller that operates the FET as a pass device.

2. Description of the Related Art

In a multiple supply fault tolerant redundant power distribution system, the paralleled power supplies are operated to contribute equally to the load current through various power/current sharing schemes. Regardless of the particular current sharing scheme, a common design practice is to include discrete ORing power diodes to protect against reverse current flow should one of the power supplies develop a catastrophic failure resulting in a high current path to ground. In addition, reverse current can occur if the current sharing scheme fails and an individual power supply voltage falls significantly below the others.

Although discrete ORing diodes have been used for some time and are relatively inexpensive to implement, there are several drawbacks to their use. One problem is the associated increasing power dissipation loss in the ORing diodes as power requirements for the system increases. The power loss across a typical ORing diode at 20 Amperes (A) is about 14 Watts (W), which becomes significant when multiplied by the number of redundant power supplies.

It is desired to provide similar functionality as the ORing diode in a redundant power distribution system without the concomitant loss of power at high loads.

SUMMARY OF THE INVENTION

A controller for regulating a FET to operate as a pass device according to an embodiment of the present invention includes input, output and gate nodes, a controlled low current device, and an oscillating high gain regulation amplifier. The input, output and gate nodes coupled to a current path input, a current path output and the gate of the FET, respectively. The voltage source provides a regulation voltage level relative to the input node. The controlled low current device is coupled to the gate node and has a control input. The regulation amplifier has a first input coupled to the output node, a second input coupled to the voltage source, and an output coupled to the control input of the controlled low current device to regulate the FET. The regulation amplifier oscillates while regulating a voltage difference between the input and output nodes to the regulation voltage level. The controlled low current device presents a high impedance to the gate node to prevent oscillations from disturbing regulation operation.

The controlled low current device may include a weak current source that provides a low level current to the gate node and a weak current sink device that draws a low level current from the gate node based on the control input. In this case, the regulation amplifier controls the weak current sink device to contradict the weak current source to maintain regulation.

The controller may further include a current sink device and a first delay filter circuit coupled between the output of the regulation amplifier and the control input of the current sink device. The current sink device sinks current from the gate node when activated sufficient to turn off the FET within a first predetermined amount of time. The first delay filter circuit activates the current sink device if the regulation amplifier goes out of regulation in one direction for a first predetermined delay that is sufficiently less than the first predetermined amount of time. The controller may further include a current source device and a second delay filter circuit coupled between the output of the regulation amplifier and the control input of the current source device. The current source device sources current to the gate node when activated sufficient to turn on the FET within a second predetermined amount of time. The second delay filter circuit activates the current source device if the regulation amplifier goes out of regulation in an opposite direction for a second predetermined delay that is sufficiently less than the second predetermined amount of time. The delay filter circuits may each include an amplifier circuit and a delay filter.

The controller may include a high speed comparator circuit having inputs coupled to the input and output nodes and an output coupled to the gate node for turning off the FET when a voltage of the input node drops below a voltage of the output node by a threshold voltage level.

A pass device for coupling an output of a power converter to a power bus according to an embodiment of the present invention includes a FET and a FET controller. The FET has a gate, an input for coupling to the power converter output and an output for coupling to the power bus. The FET controller includes a high gain regulator and a high speed comparator circuit. The regulator regulates a voltage difference between the input and output of the FET to a regulation voltage level. The high speed comparator circuit quickly turns off the FET if the voltage difference reaches a predetermined threshold voltage level indicative of a fault with the power converter.

The FET controller may further include a delayed filter current sink that turns off the FET if the regulator surpasses a first predetermined level for a first predetermined time period. The FET controller may further include a delayed filter current source that turns on the FET if the regulator surpasses a second predetermined level for a second predetermined time period. The regulator may include a voltage source, a high gain amplifier and a current device. The high gain amplifier oscillates the current device during regulation and the current device presents a relatively high impedance to the gate of the FET.

An integrated circuit (IC) that implements a FET controller for controlling a FET to operate as a pass device between a power supply and a power bus in a redundant power system according to an embodiment of the present invention includes input, output and gate pins, an oscillating regulator, a delay filter current device, and a high speed comparator. The input, output and gate pins couple to an output of the power supply, an input of the power bus and a gate of the FET, respectively. The regulator provides a high impedance regulation current to the gate pin. The delay filter current device sources current to the gate pin to slowly turn on the FET if the regulator rails in one direction for a first predetermined time period and sinks current from the gate pin to slowly turn off the FET if the regulator rails in an opposite direction for a second predetermined time period. The high speed comparator draws a high current from the gate pin to quickly turn off the FET if the input pin falls below the output pin by a threshold voltage.

BRIEF DESCRIPTION OF THE DRAWING(S)

Figure 2:
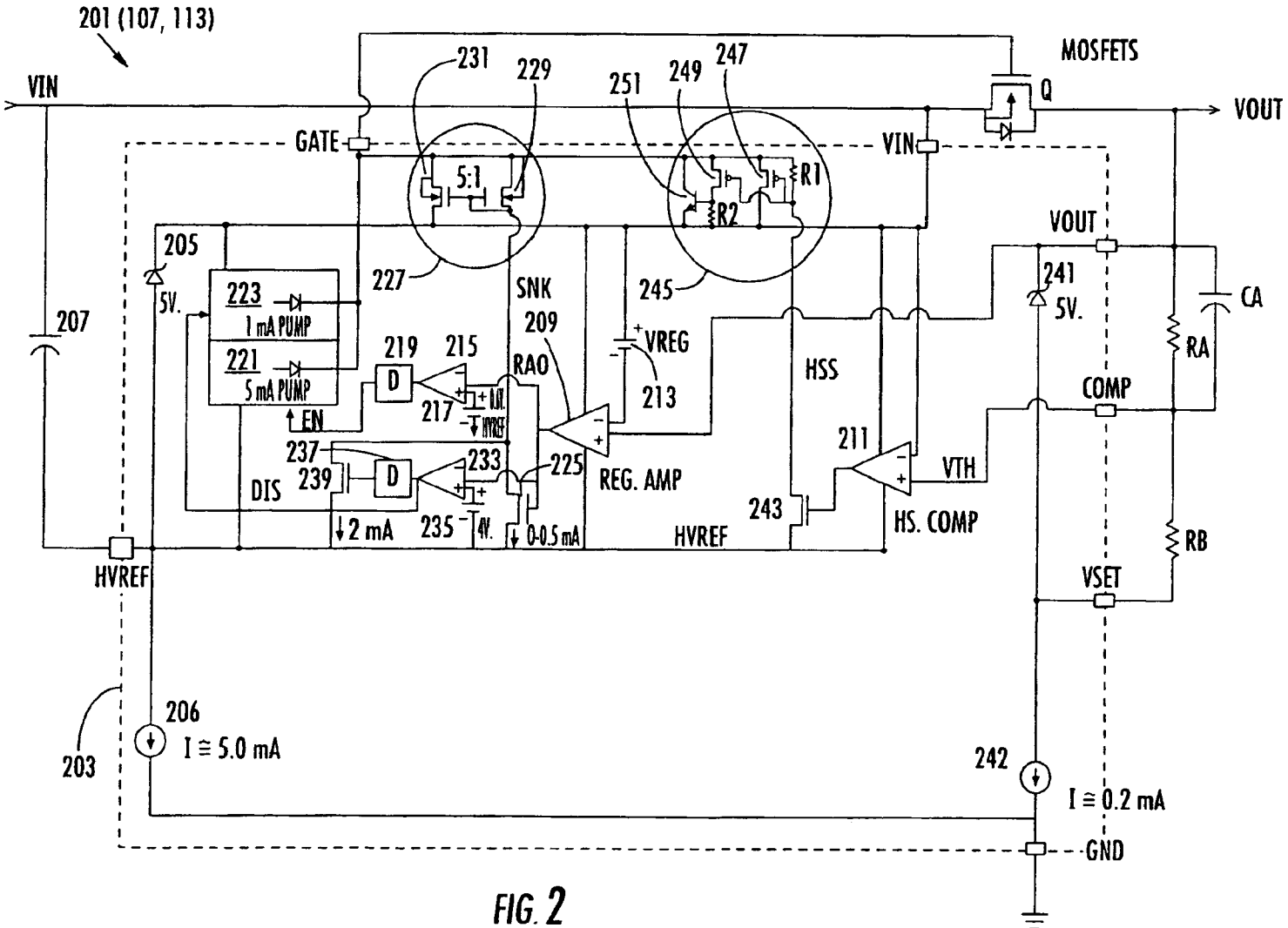

The benefits, features, and advantages of the present invention will become better understood with regard to the following description, and accompanying drawing where:

FIG. 1 is a schematic and block diagram of a redundant power distribution system using FETs as the pass devices and FET controllers implemented according to an exemplary embodiment of the present invention; and FIG. 2 is a more detailed schematic diagram of a FET controller implemented according to an exemplary embodiment of the present invention coupled to a representative FET, where the FET controller may be used as any of the FET controllers of FIG. 1.

DETAILED DESCRIPTION

The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, but is to be accorded the widest scope consistent with the principles and novel features herein disclosed.

FIG. 1 is a schematic and block diagram of a redundant power distribution system 100 implemented according to an exemplary embodiment of the present invention. A set of N AC/DC converters 101, individually numbered 101-1 to 101-N (where N is a positive integer), each have an input coupled to an AC power bus 103 and an output coupled to a DC bus 105 to convert AC power to a specified DC voltage level. In the embodiment shown, the DC voltage level of the DC bus 105 is +48V, although other voltage levels are contemplated. The AC level of the AC power bus 103 may also be any suitable level, such as a standard line voltage of +120 VAC or the like. The output of each of the AC/DC converters 101 is coupled through a corresponding one of N fuses FA1–FAN to the source of a corresponding one of N field-effect transistors (FETs) QA1–QAN. The FETs QA1–QAN are each shown as an N-channel metal-oxide semiconductor FET (or MOSFET), although other types of FETs are contemplated. The drains of the FETs QA1–QAN are coupled to the DC bus 105. A set of N FET controllers 107, individually numbered 107-1 to 107-N, are shown coupled to the FETs QA1–QAN, respectively. Each FET controller 107 is referenced to ground and includes an input node VIN coupled to the source, a GATE node coupled to the gate, and an output node VOUT coupled to the drain of a corresponding one of the FETs QA1–QAN. A load (LD) 109 is coupled to and receives power from the DC bus 105 (such as a load requiring +48 VDC).

A set of M DC/DC converters 111, individually numbered 111-1 to 111-M (where M is a positive integer), each have an input coupled to the DC bus 105 and an output coupled to a DC bus 115 to convert from one DC level to another. In the embodiment shown, the DC voltage level of the DC bus 115 is +12V, although other voltage levels are contemplated. The output of each of the DC/DC converters 111 is coupled through a corresponding one of M fuses FB1–FBM to the source of a corresponding one of M FETs QB1–QBM configured in substantially the same manner as the FETs QA1–QAN. Again, the FETs QA1–QAN are each shown as an N-channel MOSFET, although other types of FETs are contemplated. The drains of the FETs QB1–QBM are coupled to the DC bus 115. A set of M FET controllers 113, individually numbered 113-1 to 113-M, are shown coupled to the FETs QB1–QBM, respectively. Each FET controller 113 is referenced to ground and is configured in substantially the same manner as the FET controllers 107 including an input node VIN coupled to the source, a GATE node coupled to the gate, and an output node VOUT coupled to the drain of a corresponding one of the FETs QB1–QBM. A load 117 is coupled to and receives power from the DC bus 115.

The set of FETs QA1–QAN operate as ORing devices or pass devices similar to ORing diodes used in traditional designs. The AC/DC converters 101 and the DC/DC converters 111 are configured to operate using any type of current sharing scheme (not shown) and to provide redundancy to establish a fault tolerant scheme. Any type of current sharing scheme is contemplated as known to those skilled in the art and will not be further described. If any of the AC/DC converters 101 fail or are otherwise disengaged or removed, the corresponding one of the FETs QA1–QAN is turned off by the associated FET controller 107 to prevent reverse current in a similar manner as a diode. A benefit of using the FETs QA1–QAN is that they consume substantially less power then corresponding ORing diodes. For example, a 10 milliohm (mΩ) FET consumes approximately 4 W for a 20A load as compared to approximately 14 W for an ORing diode, which represents a 70% reduction in power loss. When multiplied by N devices, the power savings is significant. A particular problem with FETs, however, is that when the FET is activated or turned on, the drain to source path operates more like a resistor than a diode. Thus, each FET controller 107 operates to shut a corresponding one of the FETs QA1–QAN off in the fault condition and/or to prevent reverse current flow. Each of the M FET controllers 113 operates in a similar manner to shut a corresponding one of the FETs QB1–QBM off in the fault condition and/or to prevent reverse current flow from the DC bus 115 to the DC bus 105.

FIG. 2 is a more detailed schematic diagram of a FET controller 201 implemented according to an exemplary embodiment of the present invention coupled to a representative FET Q, where the exemplary FET controller 201 may be used as any of the FET controllers 107 or 113. The FET Q represents any of the FETs QA1–QAN or QB1–QBM. In the exemplary configuration illustrated, primary portions of the FET controller 201 are implemented on an integrated circuit (IC) 203, which includes a GATE pin for developing a GATE signal on the GATE node, a VIN pin for implementing the VIN node receiving a VIN signal from a corresponding power supply or converter (e.g., 101, 111), and a VOUT pin for developing a VOUT signal on the VOUT node. The IC 203 also includes a ground (GND) pin for coupling to a common reference or ground node. The FET Q has its source coupled to the VIN pin, its gate coupled to the GATE pin and its drain coupled to the VOUT pin of the IC 203. In this manner, the FET controller 201 controls the FET Q to operate as a pass device to provide current from a power supply to a DC bus via the drain-to-source current path of the FET Q coupled to the VIN and VOUT nodes, respectively. The FET is shown as an N-channel MOSFET, although other types of FETs are contemplated (e.g., P-channel) and the drain and source may be reversed in some configurations.

The IC 203 includes an internal Zener diode 205 having its cathode coupled to the VIN node and its anode coupled to another pin/node of the IC 203, referred to as HVREF. A current sink 206 has an input coupled to HVREF and an output coupled to GND and draws a desired current (e.g., approximately 5 milliamps (mA)) to maintain the voltage across the Zener diode 205. An external decoupling capacitor 207 is shown coupled between the VIN and HVREF nodes. The Zener diode 205, the capacitor 207 and the current sink 206 collectively operate as a floating power regulator to maintain a desired voltage source level across the Zener diode 205, such as approximately 5 Volts (V) used as a power source by internal circuitry of the IC 203. In this manner, the IC 203 may operate at relatively high voltage levels of the VIN signal, such within the 10V to 90V range, while the internal circuitry is only exposed to the lower and relatively constant voltage level between the VIN and HVREF nodes.

The primary functions of the IC 203 is centered around a high gain regulation amplifier 209 and a high speed (HS) comparator 211, each having power input terminals coupled between VIN and HVREF. The functions of the regulation amplifier 209 include activating the FET Q within a predetermined amount of turn-on time to initiate the pass functions of the FET Q, maintaining regulation of the FET Q during normal pass device operations, and shutting the FET Q off if and when the VIN sourcing power supply is turned off or ramped down relatively slowly for system diagnostics or the like. If the VIN signal drops below the voltage of VOUT by a predetermined regulation voltage VREG, regulation is lost and the gate of the FET Q is turned off slowly to avoid any voltage or current stresses on power supply components (e.g., preventing reverse voltage and/or current from other, redundant power supplies maintaining VOUT to the local power supply providing VIN). A turn-on time of approximately 1 millisecond (ms) is desired and a turn-off time of approximately 100 microseconds ($\mu$s) or less is desired. For a FET Q having a gate capacitance of approximately 50 nanofarads (nF) or the like, a 1 mA turn-on gate current is desired and a 10 mA turn-off current is desired.

The HS comparator 211 and supporting circuitry is used for fast turn off of the FET Q if VIN falls very quickly while VOUT remains constant, such as a dead short fault or the like of the local power supply. Otherwise, a reverse current would flow from VOUT to VIN pulling down the output DC bus and propagating the fault to the load which could result in an overall catastrophic failure. If the voltage of VIN falls below VOUT by a threshold fault voltage (VTH), the HS comparator 211 and supporting circuitry turns off the FET Q very quickly, such as within about 300 nanoseconds (ns) for a gate-to-source capacitance (CGS) of about 40 nF. As described further below, VTH may be externally defined and has typical values range from 0.2V to 0.4V.

A regulation voltage source 213 providing the VREG voltage has its positive terminal coupled to VIN and its negative terminal coupled to the inverting input of the regulation amplifier 209. The non-inverting input of the regulation amplifier 209 is coupled to VOUT and its output provides an output signal RAO. The regulation amplifier 209 controls the RAO signal in an attempt to maintain a voltage drop from VIN to VOUT equal to VREG to regulate operation of the FET Q as a pass device. In one embodiment, VREG is approximately 20 millivolts (mV). The RAO signal is provided to the inverting input of another amplifier 215, having its non-inverting input coupled to a voltage source 217 providing a suitable operating boundary voltage relative to HVREF, such as 0.6V. The output of amplifier 215 is coupled to the input of a delay filter 219, which has an output providing an enable signal EN to the input of a current source or charge pump 221. In the configuration shown, the delay filter 219 asserts the EN signal after a predetermined delay from when the output of the amplifier 215 is asserted high relative to HVREF. In one embodiment, the delay of the delay filter 219 is approximately 20 microseconds ($\mu$s) in response to a positive edge output from the amplifier 215, and a very low or zero delay in response to a negative edge output from the amplifier 215.

The charge pump 221 receives power from VIN and HVREF and has an output that sources current to the GATE node when enabled. In the embodiment shown, the charge pump 221 sources a current of approximately 5 mA when enabled. Another current source or charge pump 223 receives power from VIN and HVREF and also has an output sourcing a relatively weak level of current to the GATE node. The charge pump 223 is enabled during normal operation and receives a disable signal DIS that turns the charge pump 223 off when asserted.

The output of the regulation amplifier 209 is also coupled to the gate of an N-channel device 225, having its drain coupled to a sink node SNK and its source coupled to the HVREF node. The N-channel device 225 is shown as a complementary MOS (CMOS) FET or the like, although other types of current devices are contemplated. In the embodiment shown, the SNK node is coupled to an input of a current gain mirror 227, which includes a first P-channel MOSFET 229 having its drain and source coupled between the GATE and SNK nodes, its gate coupled to the SNK node (e.g., resistor coupled), and its substrate coupled to the GATE node and to the gate of another P-channel MOSFET 231. The MOSFET 231 has its drain and source coupled between the GATE and VIN nodes. In the embodiment shown, the device 225 sinks a relatively low current level from the SNK node as controlled by the regulation amplifier 209. The current gain mirror 227 is configured to sink an amplified current from the GATE node that is proportionate to the current drawn through the device 225. In the embodiment shown, for example, the device 225 draws a current ranging between 0 to 0.5 mA and the current gain mirror 227 amplifies this current level by a gain factor of 5 and thus draws an amplified current ranging from 0 to 2.5 mA from the GATE. The device 225 and the current gain mirror 227 collectively operate as a relatively weak current sink device that sinks a relatively low level of current from the GATE node as controlled by the regulation amplifier 209. It is noted that in an alternative embodiment, the device 225 could be configured to draw the 0–2.5 mA range directly. However, the current gain mirror 227 is added and coupled to VIN to reduce the amount of current that the HVREF node has to handle.

The RAO signal output from the regulation amplifier 209 is also provided to the non-inverting input of another amplifier 233, having its non-inverting input coupled to a voltage source 235 providing a suitable operating boundary voltage level relative to HVREF, such as, e.g., 4V relative to HVREF. The output of amplifier 233 provides the DIS signal to the charge pump 223 and to the input of another delay filter 237. The delay filter 237 has an output coupled to the gate of another N-channel device 239 (such as a CMOS FET or the like), which has its drain and source coupled between the SNK and HVREF nodes. In one embodiment, the device 239 sinks a current of approximately 2 mA from the SNK node when enabled. In the embodiment shown, the delay filter 237 is implemented in substantially the same manner as the delay filter 219 and incurs a delay of approximately 20 $\mu$s in response to a positive edge output from the amplifier 233, and a small or zero delay in response to a negative edge or when the DIS signal is asserted low. When the output of the regulation amplifier 209 goes above HVREF by 4V, the output of the amplifier 233 goes high asserting the DIS signal, which disables the charge pump 223. If the DIS signal remains high for the duration of the delay through the delay filter 237 (e.g., 20 $\mu$s), the delay filter 237 turns on the device 239 to sink current from the SNK node. As previously described, the current gain mirror 227 amplifies the current from the SNK node by 5, such that the 2 mA drawn by the device 239, when activated, causes a current of approximately 10 mA to be drawn from the GATE node to turn off the FET Q faster.

In operation, the IC 203 is reset or powered up and VIN is initially low. The power supply providing VIN is turned on. While VIN is low and rising, the HS comparator 211 pulls the gate of the FET Q to keep it off until VIN>VOUT−VTH, as further described below. While VIN is low, the regulation amplifier 209 asserts the RAO signal high to keep the FET Q off. In this case, the RAO signal rises above the operating boundary voltage level of the voltage source 235 relative to HVREF, and the amplifier 233 asserts the DIS signal high disabling the charge pump 223. Also, after elapse of the delay of the delay filter 237, the device 239 is activated to keep the FET Q off. The operating boundary voltage level of the voltage source 235 (e.g., 4V relative to HVREF) represents one rail (e.g., high rail) of the regulation amplifier 209 indicating that it is operating out of regulation.

Eventually, VIN rises above VOUT−VTH and the HS comparator 211 stops pulling the GATE node low. The regulation amplifier 209 keeps the RAO signal asserted high to keep the FET Q off until VIN−VREG>VOUT. When this occurs, the regulation amplifier 209 reduces the voltage level of the RAO signal to initialize regulation operation. The delay filter 237 has a relatively short or zero delay time in response to the amplifier 233 output going low, so that it asserts the DIS signal low to re-enable the charge pump 223. The charge pump 223 is turned on to begin providing current to the GATE node to the gate of FET Q to turn it on. If the FET Q does not turn on fast enough to maintain the voltage drop from VIN to VOUT to VREG, then the RAO signal is pulled low below the operating boundary voltage level of the voltage source 217 by the regulation amplifier 209 for at least the delay of the delay filter 219. The operating boundary voltage level of the voltage source 217 (e.g., 0.6V relative to HVREF) represents an opposite rail (e.g., low rail) of the regulation amplifier 209 indicating that it is operating out of regulation. At this point, the delay filter 219 asserts the EN signal to activate the larger charge pump 221 to turn the FET Q on faster. In this manner, the FET Q is turned on within the desired 1 ms time frame.

When the FET Q is turned on and regulation is achieved, the regulation amplifier 209 asserts its output above the voltage level of the voltage source 217 and the amplifier 217 pulls its output low. The delay filter 219 has a relatively short or zero delay time in response to the amplifier 217 output going low, so that it asserts the EN signal low to turn off the charge pump 221. The charge pump 223 remains turned on to maintain activation and regulation of the FET Q as a pass device during normal operation. The regulation amplifier 209 controls the device 225, which causes the current gain mirror 227 to sink current from the gate ranging from 0 to 2.5 mA. The current gain mirror 227 effectively counterbalances operation of the charge pump 223 to maintain regulation.

If VIN begins to drop, the regulation amplifier 209 increases the voltage level of the RAO signal in an attempt to maintain regulation. If VIN continues to drop relatively slowly, then the RAO signal rises above the operating boundary voltage level of the voltage source 235 and the amplifier 233 asserts the DIS signal, which turns off the charge pump 223. If the RAO signal remains high for the duration of the delay of the delay filter 237, then the delay filter 237 activates the device 239 to turn the FET Q off within the desired turn off time, such as within less than 100 $\mu$s. If for any reason the VIN signal rises above VOUT again and the regulation amplifier 209 begins regulation, the amplifier 233 negates or otherwise pulls the DIS signal and the charge pump 223 is again turned on. Also, since the delay filter 237 has a small or zero delay in response to the DIS signal going low, the device 239 is quickly turned off to turn off the device 239 to allow the FET Q to be turned back on.

It is appreciated that the regulation amplifier 209 is a high gain amplifier that controls the high gate voltage of the FET Q (i.e., several volts such as up to 10 V) to maintain the VDS voltage of the FET Q to the relatively small voltage level of VREG (e.g., 20 mV). In doing so, the regulation amplifier 209 must drive the relatively high gate capacitance of the FET Q. The high gain regulation amplifier 209 inherently has at least one low frequency internal pole, and the CGS capacitance of the FET Q contributes another low frequency pole. The two poles collectively cause the regulation amplifier 209 to be 180 degrees out of phase resulting in an unstable configuration. Such instability causes oscillations, which might otherwise interfere with the regulation of the FET Q. Normally, one of the two poles would be adjusted to be set at a higher frequency than the unity gain crossing of the amplifier to achieve stability as measured by a Bode stability plot as known to those skilled in the art. This was found to be difficult to achieve.

Instead, the regulation amplifier 209 is a high gain amplifier that is used essentially as a comparator and that is operated as a small signal oscillating amplifier in which it is operated in an unstable, yet controlled manner. In particular, the oscillations and instabilities are made tolerable by raising the output impedance of the regulation amplifier 209 sufficiently high enough so that the oscillations appearing on the GATE node are not significantly large to disturb regulation of the FET Q as a pass device. Another way of stating this is that the output of the regulation amplifier 209 is attenuated to the degree that the oscillation level is negligible. The oscillation of the RAO signal is a sinusoidal waveform with voltage levels above HVREF greater than the voltage level of the voltage source 217 and less than the voltage level of the voltage source 235. In a particular embodiment, the RAO signal oscillates between 1V and 3V above HVREF at a frequency of about 1 megahertz (MHz). The output impedance of the regulation amplifier 209 is increased by reducing the collective current level of the charge pump 223 acting in concert (or in conflict) with the device 225 (as amplified by the current gain mirror 227) to maintain regulation. The charge pump 223, the device 225 and the current gain mirror 227 collectively operate as a controlled low current device that presents a relatively high impedance to the gate of the FET Q to prevent oscillations generated by the regulation amplifier 209 from disturbing regulation operation. The oscillation levels result in sub-mV oscillations on the GATE node, which are negligible levels that do not otherwise effect operation of the FET Q as a pass device.

Although the current levels of the relatively weak charge pump 223 and the device 225 are sufficiently low to maintain regulation while not otherwise disturbing the desired operating region of the FET. Q, these current levels are not sufficiently high to achieve the desired turn-on and turn-off timing parameters previously described. If an out-of-regulation condition has a duration longer than the delay period of the delay filters 219 or 237, then the larger current devices 221 or 239 are activated. The charge pump 221 sources a sufficient current level to meet the desired turn-on time whereas the device 239 (as amplified by the current gain mirror 227) sinks a sufficient current level to meet the desired turn-off time of the FET Q. Another advantage of the delay filters 219 and 237 is that they filter out the switching noises from the high noise environment of the FET controller 201. These switching noises typically occur in the 100 kilohertz (kHz) to 500 kHz frequency range, which are sufficiently high to prevent activation of the higher current sources/sinks, or to prevent activation for a significant amount of time. The device 239 (as amplified by the current gain mirror 227) does not sink a sufficient current level to meet the desired turn-off time when the VIN signal is decreased relatively quickly, such as when the VIN signal is suddenly shorted or suddenly drops by a significant amount.

Another Zener diode 241 has its cathode coupled to the VOUT node and its anode coupled to a pin/node VSET of the IC 203. A current sink 242 has an input coupled to the VSET node and an output coupled to GND to draw enough current through the Zener diode 241 to maintain a reference voltage across VOUT to VSET of approximately 5V. A voltage divider is externally coupled between the VOUT and VSET pins to develop the desired threshold fault voltage VTH at a compensation (COMP) pin/node of the IC 203. In particular, a resistor RA is coupled between the VOUT and COMP pins and another resistor RB is coupled between the COMP and VSET pins. A filter capacitor CA is also shown coupled between the VOUT and COMP pins. The Zener diode 241, the current sink 242, the resistors RA and RB and the capacitor CA collectively form a compensation circuit for establishing the threshold voltage VTH. The values of the resistor RA and RB are selected to divide the reference voltage established by the Zener diode 241 to the desired voltage level of the VTH signal relative to VOUT. The VTH signal is provided to the non-inverting input of the HS comparator 211, which has its inverting input coupled to VIN. The output of the HS comparator 211 is coupled to the gate of an N-channel device 243, which is shown as an N-channel CMOS FET. The drain and source of the device 243 is coupled between the HVREF node and a high speed shutoff (HSS) node. The HSS node is coupled to the input of a high current gain device 245 coupled between the GATE and VIN nodes.

In the specific embodiment illustrated, the high current gain device 245 includes first and second resistors R1 and R2, a pair of P-channel devices 247 and 249 and a bipolar junction transistor (BJT) 251. The devices 247 and 249 are shown as P-channel CMOS FETs. The resistor R1 is coupled between the GATE and HSS nodes. The device 247 has its source coupled to the GATE node, its drain coupled to VIN and its gate coupled to HSS. The device 249 has its source coupled to the GATE node, its gate coupled to the gate of the device 247, and its drain coupled to one end of the resistor R2 and to the base of the BJT 251. The other end of the resistor R2 and the emitter of the BJT 251 are coupled to VIN. The collector of the BJT 251 is coupled to the GATE node.

In operation, the HS comparator 211 asserts its output low keeping the device 243 off when the voltage of VIN is greater than VOUT−VTH. In one embodiment, VTH is approximately 0.3V, although other voltage levels may be programmed as desired via the respective resistive values of the resistors RA and RB. When the device 243 is off, the devices 247 and 249 are also off turning off the BJT 251. If VIN falls below VOUT−VTH (or falls below VOUT by VTH or more), the HS comparator 211 asserts its output high turning on the device 243. The device 243 couples the HSS node to HVREF turning on the devices 247 and 249, which activate the BJT 251. The BJT 251 draws a very high current level from the GATE node to VIN to quickly shut off the FET Q. In one embodiment, the high current gain device 245 sinks a current of approximately 5A from the GATE node to shut off the FET Q almost instantaneously (e.g., within 300 ns), although other current levels are contemplated.

In summary, a FET controller is provided to control a FET to operate as an ORing or pass device in a redundant power distribution system. The use of FETs as the pass devices, as compared to ORing diodes or the like, saves a substantial amount of power. A high gain amplifier is provided within the FET controller to control the gate of the FET to regulate the FET's VDS to a relatively small voltage level during regulation. The regulation amplifier is operated in an unstable region in which its output oscillates. Weak current devices are provided at the output of the regulation amplifier to ensure that the oscillations do not appreciably effect pass device operation. Delay filters are also coupled at the output of the regulation amplifier to sense an out-of-regulation condition enduring for a predetermined amount of time. The delay filters activate higher current sources to achieve desired turn-on and turn-off times which are not otherwise achieved using the weak current devices. A high speed comparator circuit activates a strong current source to quickly turn off the FET in the event the input drops fast or larger than a predetermined threshold level relative to the output voltage, such as when the input power supply is shorted or its voltage drops suddenly.

Although the present invention has been described in considerable detail with reference to certain preferred versions thereof, other versions and variations are possible and contemplated. The specific device-types, component values, circuit configurations and/or voltage current levels, for example, are exemplary only and not intended to limit the present invention to the specific embodiments. Those skilled in the art should appreciate that they can readily use the disclosed conception and specific embodiments as a basis for designing or modifying other structures for providing out the same purposes of the present invention without departing from the spirit and scope of the invention as defined by the appended claims.

What is claimed is:

1. A controller for regulating a FET to operate as a pass device, the FET including a gate and a current path having an input and an output, said controller comprising:

input, output and gate nodes for coupling to the current path input, the current path output and the gate of the FET, respectively;

a voltage source, coupled to said input node, that provides a regulation voltage level relative to the input node;

a controlled low current device, coupled to said gate node and having a control input; and a high gain regulation amplifier having a first input coupled to said output node, a second input coupled to said voltage source, and an output coupled to said control input of said controlled low current device to regulate the FET;

wherein said regulation amplifier functions as a small signal oscillator.

2. The controller of claim 1, wherein said regulation amplifier oscillates while regulating a voltage difference between said input and output nodes to said regulation voltage level and wherein said controlled low current device presents a high impedance to said gate node to prevent oscillations from disturbing regulation operation.

3. The controller of claim 1, wherein said controlled low current device comprises:

a weak current source providing a low level current to said gate node; and a weak current sink device that draws a low level current from said gate node based on said control input;

wherein said regulation amplifier controls said weak current sink device to contradict said weak current source to maintain regulation.

4. The controller of claim 1, further comprising:

a current sink device, coupled to said gate node and having a control input, that sinks current from said gate node when activated sufficient to turn off the FET within a first predetermined amount of time; and a first delay filter circuit coupled between said output of said regulation amplifier and said control input of said current sink device;

wherein said first delay filter circuit activates said current sink device if said regulation amplifier goes out of regulation in one direction for a first predetermined delay that is sufficiently less than said first predetermined amount of time.

5. The controller of claim 4, wherein said first delay filter circuit comprises:

an amplifier circuit that compares said output of said regulation amplifier with a regulation voltage level and that asserts a disable signal indicative thereof; and a delay filter, coupled to said current sink device and that receives said disable signal.

6. The controller of claim 4, further comprising:

a current source device, coupled to said gate node and having a control input, that sources current to said gate node when activated sufficient to turn on the FET within a second predetermined amount of time; and a second delay filter circuit coupled between said output of said regulation amplifier and said control input of said current source device;

wherein said second delay filter circuit activates said current source device if said regulation amplifier goes out of regulation in an opposite direction for a second predetermined delay that is sufficiently less than said second predetermined amount of time.

7. The controller of claim 6, wherein said second delay filter circuit comprises:

an amplifier circuit that compares said output of said regulation amplifier with a regulation voltage level and that asserts a regulation signal indicative thereof; and a delay filter, coupled to said current source device and that receives said regulation signal.

8. The controller of claim 1, further comprising a high speed comparator circuit having inputs coupled to said input and output nodes and an output coupled to said gate node for turning off the FET when a voltage of said input node drops below a voltage of said output node by a threshold voltage level.

9. The controller of claim 8, wherein said high speed comparator circuit comprises:

a compensation circuit, coupled to said output node, providing said threshold voltage level;

a current sink device, coupled to said gate node and having a control input, that sinks a high current from said gate node when activated sufficient to turn off the FET within a predetermined amount of time; and a comparator having a first input coupled to said input node, a second input coupled to said compensation circuit, and an output coupled to said control input of said current sink device.

10. The controller of claim 1, further comprising a floating voltage source providing a voltage reference node relative to said input node for providing power to circuitry coupled between said input and voltage reference nodes.

11. The controller of claim 10, wherein said controlled low current device comprises:

a weak current device, coupled to said voltage reference node, having said control input and an output; and a current gain mirror, coupled between said input and gate nodes and having a control input coupled to said control input of said weak current device, and operative to sink a proportionate current from said gate node to said input node generated by said weak current device.

12. A pass device for coupling an output of a power converter to a power bus, comprising:

a FET having a gate, an input for coupling to the power converter output and an output for coupling to the power bus; and a FET controller, comprising:

a high gain regulator, having first and second inputs and an output coupled to said input, said output and said gate of said FET, respectively, that regulates a voltage difference between said input and output of said FET to a regulation voltage level; and a high speed comparator circuit, having first and second inputs coupled to said input and output of said FET and an output coupled to said gate of said FET, that quickly turns off said FET if the said voltage difference reaches a predetermined threshold voltage level indicative of a fault with the power converter;

wherein said regulator operates as a small signal oscillator.

13. The pass device of claim 12, wherein said FET controller further comprises a delayed filter current sink, coupled between said gate of said FET and said output of said regulator, that turns off said FET if said regulator surpasses a predetermined level for a predetermined time period.

14. The pass device of claim 13, wherein said delayed filter current sink comprises:

a current sink coupled to said gate of said FET and having a control input; and a delay filter coupled between said output of said regulator and said control input of said current sink.

15. The pass device of claim 12, wherein said FET controller further comprises a delayed filter current source, coupled between said gate of said FET and said output of said regulator, that turns on said FET if said regulator surpasses a predetermined level for a predetermined time period.

16. The pass device of claim 15, wherein said delayed filter current source comprises:

a current source coupled to said gate of said FET and having a control input; and a delay filter coupled between said output of said regulator and said control input of said current source.

17. The pass device of claim 12, wherein said regulator comprises:

a voltage source coupled to said input of said FET and providing said regulation voltage level relative to said input of said FET;

a high gain amplifier having a first input coupled to said voltage source, a second input coupled to said output of said FET, and an output; and a current device having an output coupled to said gate of said FET and a control input coupled to said output of said high gain amplifier.

18. The pass device of claim 17, wherein said high gain amplifier oscillates said current device during regulation and wherein said current device presents a relatively high impedance to said gate of said FET.

19. The pass device of claim 17, wherein said current device comprises:

a current source that sources current to said gate of said FET; and a controlled current sink having a control input coupled to said output of said high gain amplifier;

wherein said high gain amplifier controls said controlled current sink to counterbalance said current source during regulation.

20. The pass device of claim 12, wherein said high speed comparator circuit comprises:

a compensation circuit coupled to said output of said FET that provides said threshold voltage level relative to said output of said FET;

a comparator having a first input coupled to said input of said FET, a second input coupled to said compensation circuit and an output; and a high level current sink having an output coupled to said gate of said FET and a control input coupled to said output of said comparator.

21. An integrated circuit (IC) that implements a FET controller for controlling a FET to operate as a pass device between a power supply and a power bus in a redundant power system, said IC comprising:

input, output and gate pins for coupling to an output of the power supply, an input of the power bus and a gate of the FET, respectively;

an oscillating regulator having first and second inputs and an output coupled to said input, output and gate pins, respectively, that provides a high impedance regulation current to said gate pin;

a delay filter current device, having a control input coupled to said output of said regulator and an output coupled to said gate pin, that sources current to said gate pin to slowly turn on the FET if said regulator rails in one direction for a first predetermined time period and that sinks current from said gate pin to slowly turn off the FET if said regulator rails in an opposite direction for a second predetermined time period; and a high speed comparator having first and second inputs and an output coupled to said input, output and gate pins, respectively, that draws a high current from said gate pin to quickly turn off the FET if said input pin falls below said output pin by a threshold voltage.

* * * * *